United States Patent [19]

Kurihara et al.

[11] 4,263,847

[45] Apr. 28, 1981

[54] PRINTING MECHANISM FOR DOT MATRIX IMPACT PRINTERS

[75] Inventors: Toshio Kurihara, Tokorozawa; Nagao Mizutani, Hachiouji; Tsutomu Iesaka, Sayama, all of Japan

[73] Assignee: Citizen Watch Co., Ltd., Tokyo, Japan

[21] Appl. No.: 77,263

[22] Filed: Sep. 20, 1979

[30] Foreign Application Priority Data

| | | | |
|---|---|---|---|
| Sep. 20, 1978 | [JP] | Japan | 53-114483 |
| Sep. 20, 1978 | [JP] | Japan | 53-114484 |
| Sep. 26, 1978 | [JP] | Japan | 53-118186 |

[51] Int. Cl.[3] ..... B41J 3/08

[52] U.S. Cl. ..... 101/93.04; 400/121; 346/101

[58] Field of Search ..... 400/118, 121, 383, 470, 400/471, 662; 101/93.04; 346/101

[56] References Cited

U.S. PATENT DOCUMENTS

| | | | |
|---|---|---|---|
| 3,810,195 | 5/1974 | Kilroy et al. | 101/93.04 X |
| 3,812,495 | 5/1974 | Venker | 101/93.04 X |
| 3,834,304 | 9/1974 | Potter | 101/93.04 |
| 3,843,955 | 10/1974 | Pear | 101/93.04 X |
| 4,164,744 | 8/1979 | Freude | 400/470 X |

FOREIGN PATENT DOCUMENTS 278225 9/1914 Fed. Rep. of Germany ..... 400/662

OTHER PUBLICATIONS

"Porous Coating For Type Element", by E. J. Bonafino, et al., IBM Tech. Disc. Bulletin, vol. 15, No. 4, Sep. 1972, p. 1290, 400-470.

*Primary Examiner*—Paul T. Sewell

*Attorney, Agent, or Firm*—Birch, Stewart, Kolasch & Birch

[57] ABSTRACT

A dot matrix impact printer of the type which has a platen having a helical projection, a plurality of hammers arranged in the axial direction of the platen to cross the helical projection, and means for feeding an ink to the periphery of the helical projection. The platen is rotated and the hammer strikes the helical projection interposing the recording paper, so that dot matrix printing may be performed. In order to prevent the contamination of the recording paper with the ink, there is provided a separating member of resilient material along the helical projection. The periphery of the separating member is slightly higher than the helical projection, so that the recording paper is separated from the helical projection. The separating member is compressed by impacting the hammer so that the ink may be transferred to the paper.

12 Claims, 17 Drawing Figures

PRINTING MECHANISM FOR DOT MATRIX IMPACT PRINTERS

BACKGROUND OF THE INVENTION

The present invention relates to a printing mechanism for a dot matrix impact printer of the crossing type comprising a helical projection provided on the periphery of a platen and a plurality of hammers, each of which hammers is so arranged that the hammer head crosses the helical projection of the platen for performing the dot matrix impact printing.

A dot printer may be classified into an impact printer and a non-impact printer, most of which employ the serial printing system, that is, the printing is serially carried out from end to end of the recording paper. The serial printing system has an advantage that printing cost per unit length on the recording paper is low, if printing width is comparatively long. However, the cost increases with decrease of the printing width.

On the other hand, the impact printer is now largely used, since a clear print may be obtained and, further, printing on sheet paper with carbon copies can be made. Generally, the impact printer employs an inked ribbon printing system, in which printing is performed by impacting a hammer to the recording paper on a drum, with the interposition of the ink ribbon. However the inked ribbon system produces some disadvantages as follows: Construction of the machine is complicated by the ribbon driving means; when a cloth ribbon is used, clearness of the printing is blurred by the texture of the ribbon represented in the print portion; the ribbon must be often changed; the changing operation is troublesome; and the hands of the operator are stained with ink.

If an ink roller inking system comprising an ink roller of sponge material is employed, the above described disadvantages of the ink ribbon system may be eliminated. However, the ink roller inking system has the deficiency that if a portion of the recording paper other than the printed portion accidentally touches a type drum or other parts wetted with ink, the paper is contaminated with the ink. Therefore, in the impact printer, especially in the dot matrix impact printer of the crossing type, it is difficult to design an ink roller inking system which enables printing without the contamination of the paper.

SUMMARY OF THE INVENTION

The main object of the present invention is to provide a printing mechanism having an inking means for a dot matrix impact printer of the crossing type which may make a clear print without staining the recording paper with ink.

Another object of the present invention is to provide a dot matrix impact printer which is compact and economical and may be easily manipulated.

According to the present invention, there is provided a printing mechanism for dot matrix impact printers comprising a platen, a helical separating member made of resilient material provided on the periphery of the said platen, a helical disclosed portion of said platen adjacent said helical separating member, the periphery of said helical separating member being higher than said helical disclosed portion, a plurality of hammers arranged in the axial direction of said platen, each of said hammers having a hammer head which is provided to cross said helical disclosed portion, means for feeding ink to the periphery of said helical disclosed portion, means for rotating said platen, and means for moving said hammers to said platen compress said resilient separating member to perform the dot matrix impact printing.

These and other objects and features of the present invention will become more fully apparent from the following description with reference to the accompanying drawings.

DESCRIPTION OF THE PREFERRED EMBODIMENTS

Figure 1:
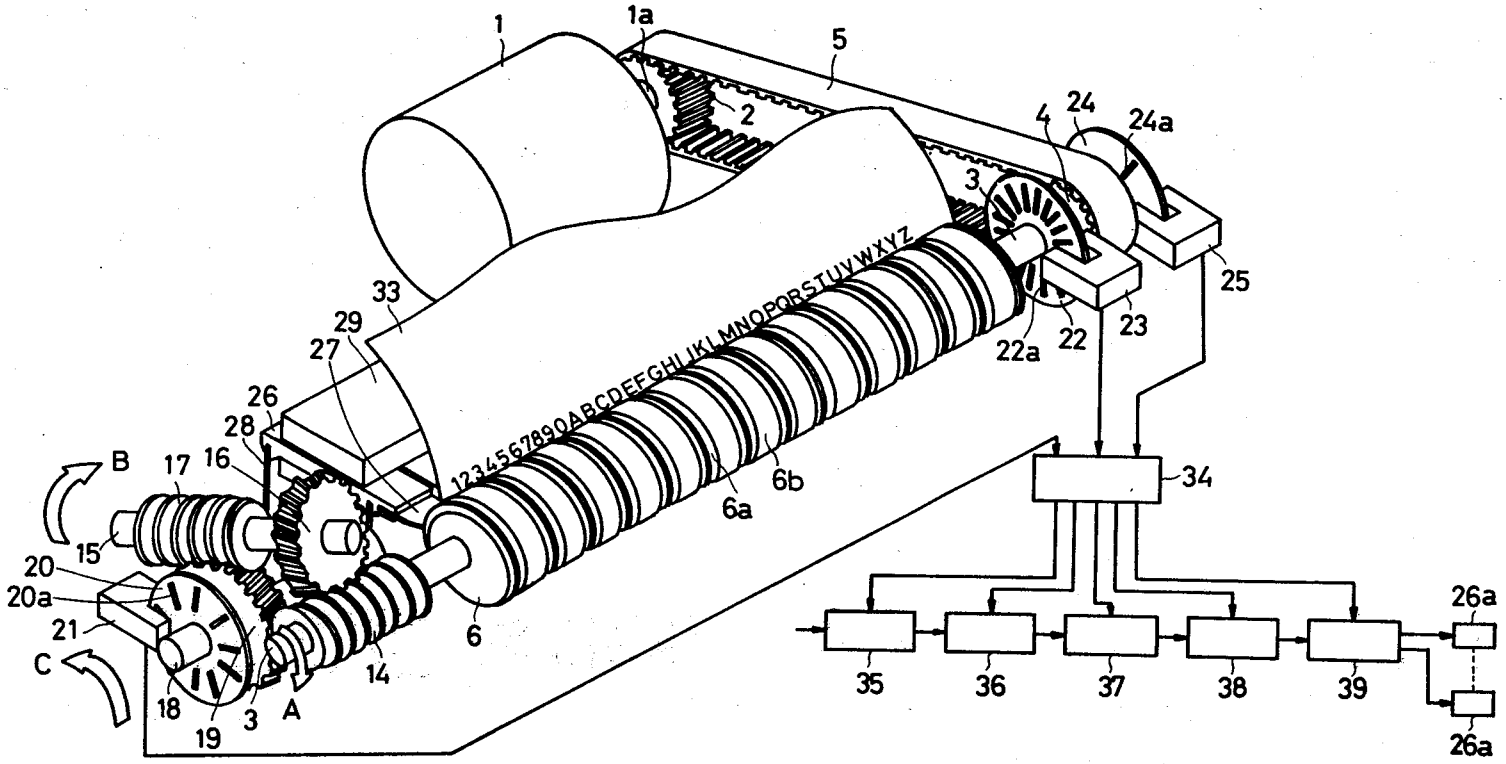
FIG. 1 is a perspective view showing a first embodiment of a dot matrix impact printer according to the present invention.
Figure 2:
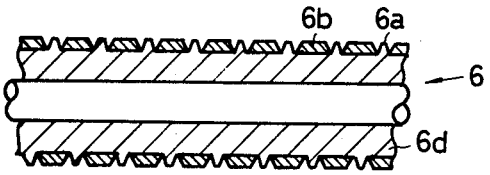
FIG. 2 is a sectional view showing a construction of a platen in the printer of FIG. 1.

Referring to FIGS. 1 to 4, numeral 1 designates a motor wherein the rotary shaft 1*a* thereof has a pulley 2 secured thereto. The pulley 2 is connected to a pulley 4 of a platen shaft 3 by a belt 5. The platen shaft 3 is rotatably supported on a not shown frame of the printer. A platen 6 secured to the platen shaft 3 is made of porous material having an absorbency for ink, such as sponge rubber, sintering metal or plastics. As shown in FIG. 2, the platen 6 comprises an ink-containing portion 6*d* and a helical projection 6*a* as a disclosed portion provided on the periphery thereof for transferring the ink to the recording paper. In the helical groove along the helical projection 6*a*, a separating member 6*b* is provided such that the periphery of the member 6*b* is slightly higher than the projection 6*a*. The separating member 6*b* is made of elastic material such as rubber, steel plate and plastics. As described hereinafter, the member 6*b* acts to separate a recording paper from the platen 6.

Secured on the other end of the platen shaft 3 is a first worm 14 which is engaged with a first worm wheel 16 fixedly mounted on a shaft 15 rotatably supported on the frame. A second worm 17 provided on the shaft 15 engages with a second worm wheel 19 secured to a feed roller shaft 18 rotatably mounted on the printer frame. These gear assemblies are so arranged that when the platen shaft 3 rotates in the direction of arrow "A", the shafts 15 and 18 rotate in the direction of "B" and "C", respectively.

Secured on the feed roller shaft 18 is a first timing disk 20 having ten radial slits 20*a* spaced equidistance. A first timing sensor 21 is provided on the not shown frame adjacent the first timing disk 20. The first timing sensor 21 has a light emitting element disposed on one side of the disk 20 and a light receiving element disposed on opposite side of the disk for producing an electrical signal upon receiving the light from the light emitting element passing through one of slits 20*a*. A second timing disk 22 having twenty-one slits 22*a* is secured to the platen shaft 3 and a second timing sensor 23 similar to the first timing sensor 21 is provided adjacent the second timing disk. Further, a third timing disk 24 having one slit 24*a* is secured to the platen shaft 3 and a third timing sensor 25 is also provided in connection with the third timing disk.

Figure 4:
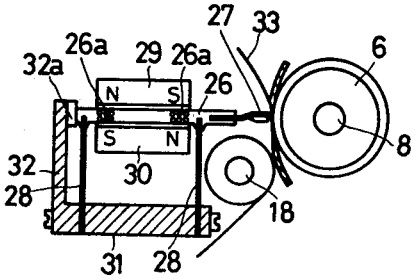
FIG. 4 is a sectional side view of the printer.

A plurality of hammers 26 are disposed adjacent the platen 6 arranged in the axial direction with a pitch equal to that of the helical projection 6*a* of the platen 6. Each hammer is made of plastic and has a driving coil 26*a* embeded therein as shown in FIG. 4.

Figure 3:
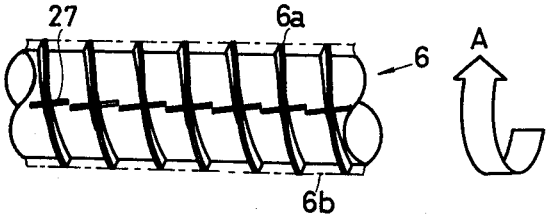
FIG. 3 shows the relationship between the platen and hammers.

The hammer has a hammer head 27 in the shape of a plate which has a linear impact face and is disposed to cross the projection 6*a*. The hammer head has a width nearly equal to the pitch of the helical projection and is slightly tilted relative to the axial line of the platen as shown in FIG. 3. Each hammer 26 is supported by a pair of resilient plates 28 secured to a frame 31 so that the hammer may be moved to the platen 6 without deflecting. In the home position, the hammer is pressed against a stopper 32*a* provided on a frame 32. A pair of magnets 29, 30 are disposed in opposite sides of the hammer array. Both magnets are inverted with each other in polarity. The driving coil 26*a* and the magnets 29 and 30 are so arranged that the hammer 26 is moved to the platen 6 by energization of the driving coil.

In operation, the platen 6 is rotated by the motor 1 through the belt 5 in the direction of the arrow "A " in FIG. 1. A recording paper 33 is fed by rotation of the feed roller shaft 18. By centrifugal force, the ink contained in the platen moves outwardly to thereby wet the helical projection 6*a*. However, since the recording paper is separated from the helical projection 6*a* by the separating member 6*b*, the paper is not stained with the ink. Therefore, when the hammer strikes the platen 6, the separating member 6*b* is compressed by the hammer head 27, so that the recording paper may be pressed against the helical projection 6*a*. Thus, the ink on the projection is transferred to the paper at the impacted crossing point of the hammer head and the projection to make a print.

In an example, the feed roller shaft 18 is rotated at the rate of one revolution per 110 revolutions of the platen 6 to feed the recording paper 33. During the rotation of the feed roller shaft 18, the first timing sensor 21 produces one timing signal every 36 degrees rotation of the shaft 18. The second timing sensor 23 generates one timing signal every 120/7 degrees revolution of the platen 6 and the third timing sensor 25 generates one timing signal per one revolution of the platen. By the first timing signal from the sensor 21 and the third timing signal from the sensor 25, the position of the printing row on the recording paper 33 may be informed. Further, position of the crossing point of the helical projection 6*a* and the hammer head 27, that is, the position of the printed dot, may be informed by the three kinds of signals. Thus, by controlling the energization of the driving coil 26*a* of each hammer according to the timing signals, a desired character may be printed by the dot matrix, for example by dots arranged in the matrix comprising 5 columns and 7 rows.

Explaining an example of the control means, timing signals from three timing sensors 21, 23 and 25 are applied to a sequence circuit 34. The sequence circuit is adapted to control an interface 35, a register 36, a print signal generator 37, a buffer 38, and solenoid driver 39. The interface 35 is, for example connected to a computor, the register 36 memorizes the output of the interface and the print signal generator 37 is adapted to convert the output of the register 36 to a print signal at every row of the matrix and to apply the signal to the solenoid driver 39 through the buffer 38. Thus, the solenoid driver 39 acts to energize the driving coils 26*a* in accordance with the print signal from the print signal generator 37, so that dot matrix printing is performed.

It will be seen that a graphic print may also be carried out in this printer, since the dot may be printed without blank in the actuating range of the hammer head.

Since the recording paper 33 is continuously fed, the hammer head 27 is slightly tilted relative to the axial line of the platen. However, if the paper is fed intermittently in synchronism with the printing, the hammer head is arranged in the axial direction.

Figure 5:
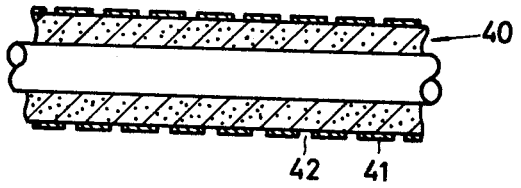
FIG. 5 is a sectional view showing a platen in a second embodiment of the present invention.

Referring to FIG. 5 showing a part of the second embodiment of the present invention, a platen 40 is made of porous material like the first embodiment. The platen is of a cylindrical body without a helical projection unlike the first embodiment. On the periphery of the platen, a helical separating member 41 of resilient material is provided to form a helical groove 42. Thus, ink included in the platen 40 is moved to the groove 42 by the centrifugal force. Other parts of the second embodiment are the same as the first embodiment. Therefore, when the hammer strikes the platen, the helical separating member 41 is compressed, so that ink in the groove 42 is transferred to the paper. Thus, the dot matrix impact printing may be performed in the same manner as the first embodiment.

Figure 6A:
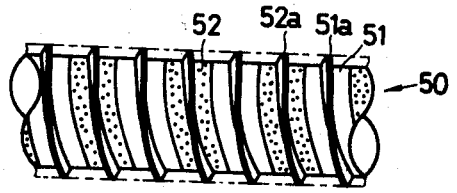
FIG. 6*a* shows a platen in a third embodiment of the present invention.
Figure 6B:
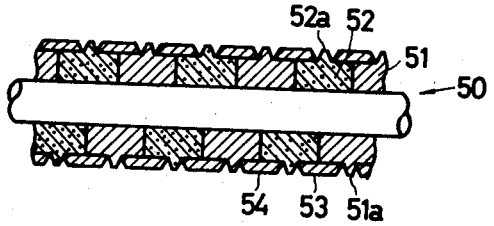
FIG. 6*b* is a sectional view of the platen of FIG. 6*a*.

Referring to FIGS. 6*a* and 6*b* showing the third embodiment which is for two-color printing, a platen 50 of porous material comprises a helical first-ink-containing portion 51 having a helical projection 51*a* and a helical second-ink-containing portion 52 having a helical projection 52*a*. On the periphery of the platen between the helical projections 51*a* and 52*a*, resilient separating members 53 and 54 are fixedly provided. Periphery of each separating member is slightly higher than the helical projection as the first embodiment.

In the first-ink-containing portion 51, black ink is contained and red ink is absorbed in the second-ink-containing portion 52. Thus, when the helical projection 51*a* of the black ink containing portion 51 is in the range of the hammer head, printing is performed, by actuation of the hammer, in black ink. Similarly, when the red ink containing portion 52 is in the range of the hammer head, red ink printing is made. Therefore, by controlling the hammers, a black ink printing, a red ink printing and a two-color printing may be selectively performed. If in a platen having a plurality of ink-containing portions, more than two portions are provided, a multicolor print and a multicolor graphic print may be made.

Figure 7:
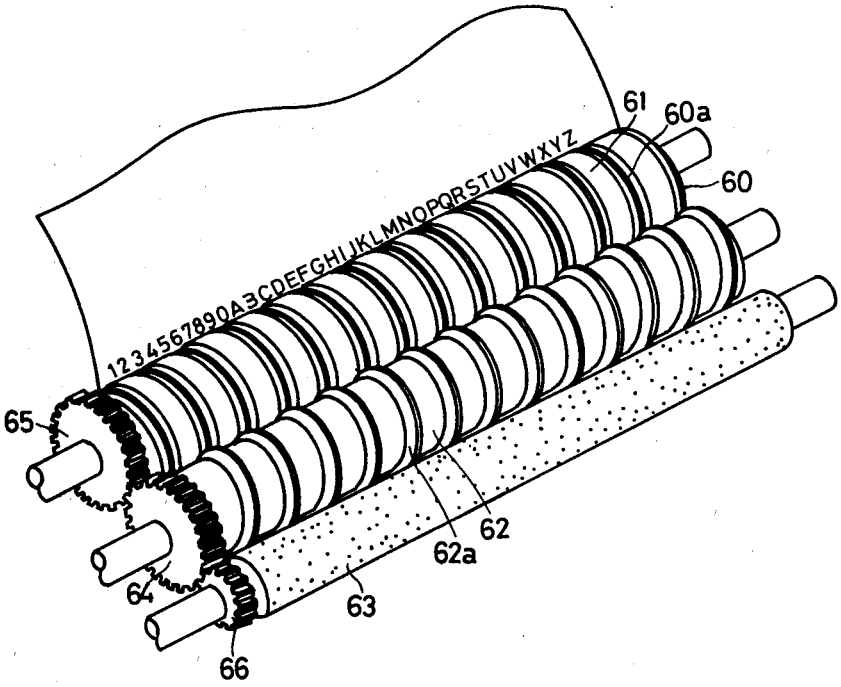
FIG. 7 is a perspective view showing a part of a fourth embodiment of the present invention.

Referring to FIG. 7 showing the fourth embodiment, a platen 60 has a helical projection 60*a* and a resilient separating member 61 along the helical projection, like the first embodiment. A transferring roller 62 having a helical projection 62*a* is provided adjacent the platen 60. The platen 60 and the transferring roller 62 are adapted to touch each other at the peripheries of helical projections. The helical projection 62*a* is the same as the helical projection 60*a* in peripheral diameter and pitch, but the lead angle of the helix is reversed. An ink roller 63 is made of porous material similar to the platen in the first embodiment and touched to the periphery of the helical projection 62*a*. The ink transferring roller 62 is rotated through a gear 64 engaged with a gear 65 of the platen 60 at the same speed as the platen and the ink roller 63 is rotated through a gear 66 engaged with the gear 64. Other portions of the embodiment are the same as the first embodiment.

In operation, ink contained in the ink roller moves to the periphery thereof by the centrifugal force and transferred to the periphery of the helical projection 62*a*. Since the periphery of the helical projection 62*a* touches continuously the periphery of the helical projection 60*a*, the ink is transferred to the periphery of the helical projection 60*a*. Thus, dot matrix impact printing is performed in the same manner as the first embodiment.

Figure 8A:
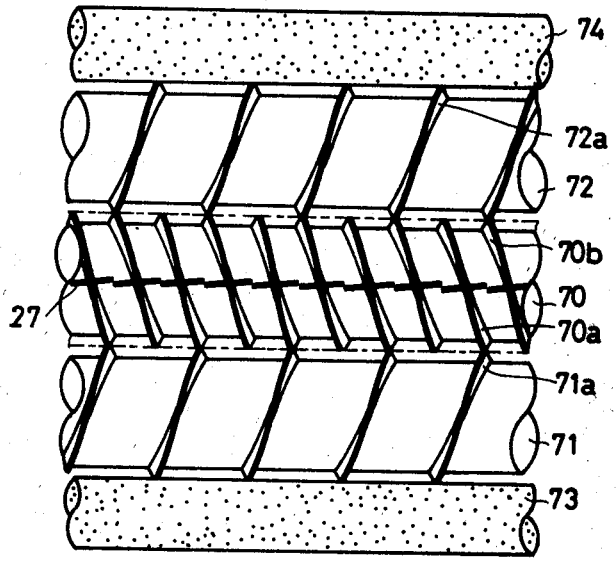
FIG. 8*a* is a developed plan view showing a part of a fifth embodiment of the present invention.
Figure 8B:
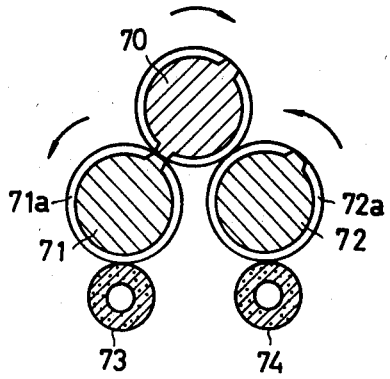
FIG. 8*b* is a sectional side view of the part of FIG. 8*a*.

Referring to FIGS. 8*a* and 8*b*, this embodiment is for two-color printing. The printer comprises a platen 70 having two helical projections 70*a* and 70*b*, a pair of ink transferring rollers 71 and 72, and a black ink roller 73 and a red ink roller 74. The platen 70 has a separating member (not shown) like the previous embodiments. The first ink transferring roller 71 has a helical projection 71*a* which abuts the first helical projection 70*a* and the black ink roller 73. The second ink transferring roller 72 has a helical projection 72*a* which touches the second helical projection 70*b* and the red ink roller 74.

Thus, the black ink is transferred from the ink roller 73 to the first helical projection 70*a* through the first ink transferring roller 71 and the red ink is transferred from the ink roller 74 to the second helical projection 70*b* through the second ink transferring roller 72. Therefore, by actuating the hammer head 27 in such a manner as described about the third embodiment shown in FIGS. 6*a* and 6*b*, black ink printing, red ink printing and mix printing may be selectively made.

Figure 9A:
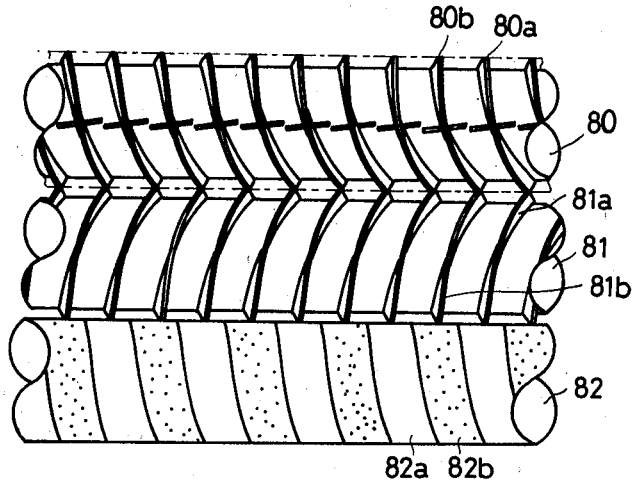
FIG. 9*a* is a developed plan view showing a part of a sixth embodiment.
Figure 9B:
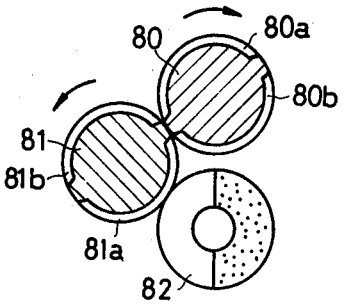
FIG. 9*b* is a sectional side view of the part of FIG. 9*a*.

Referring to FIGS. 9*a* and 9*b*, this embodiment is also for two-color printing. The printer comprises a platen 80 having two helical projections 80*a* and 80*b*, an ink transferring roller 81 having two helical projections 81*a* and 81*b* and an ink roller 82, which are touched with each other. The platen 80 is the same as the platen 70 in the embodiment of FIGS. 8*a* and 8*b*. The ink roller 82 has two helical ink containing portions 82*a* and 82*b* for black and red inks. These helixes have the same diameter and the lead angles of the helixes are reversed. The platen 80 and rollers 81 and 82 are rotated at the same speed in the counter-direction to the adjacent one. Thus, the black ink and red ink contained in the ink roller 82 are transferred to the platen 80 through the ink transferring roller 81 and two-color printing may be carried out.

Figure 10:
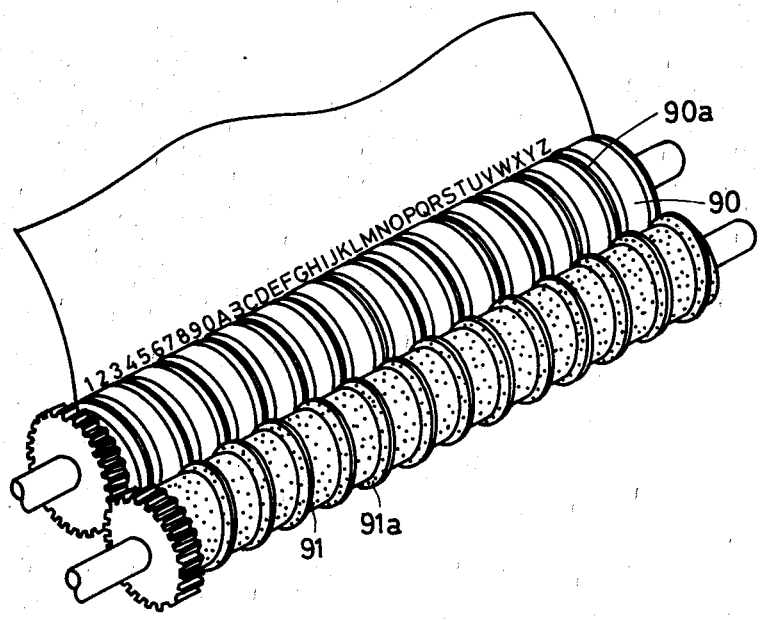
FIG. 10 is a perspective view showing a part of a seventh embodiment.

Referring to FIG. 10 showing the seventh embodiment, the printer comprises a platen 90 and an ink roller 91. The platen 90 is the same as the platen of the printer shown in FIG. 7. The ink roller 91 is made of sponge material for containing an ink and has a helical projection 91*a* having a diameter equal to that of the platen and reversed lead angle. Both rollers are rotated at the same rate with engaging the peripheries of the helical projections. Thus, the ink contained in the ink roller 91 is transferred to the helical projection 90*a* of the platen. Other portions are the same as previous embodiments in construction and operation.

Figure 11:
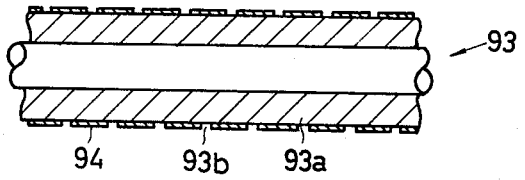
FIG. 11 is a sectional view showing a platen of an eighth embodiment.

FIG. 11 shows a platen 93 of the eighth embodiment. The platen comprises a cylindrical body 93*a* and a helical separating member 94 of resilient material. The helical groove 93*b* formed along the helical separating member is engaged by the same ink roller (not shown) as the ink roller 91 in the FIG. 10, so that the ink contained in the ink roller is transferred to the helical groove 93*b*.

Figure 12A:
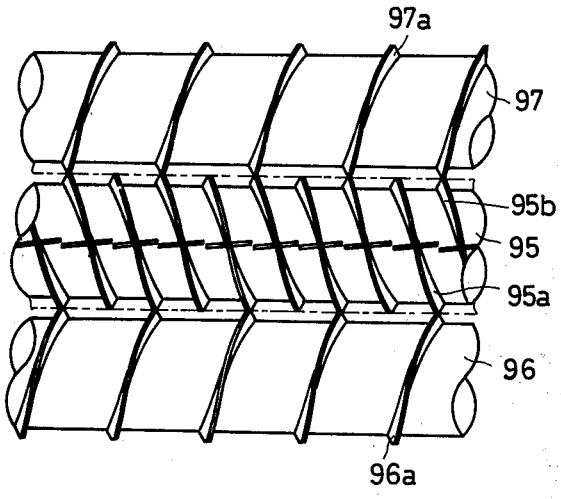
FIG. 12*a* is a developed plan view showing a part of a nineth embodiment.
Figure 12B:
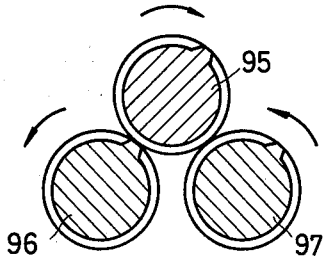
FIG. 12*b* is a sectional view of the part of FIG. 12*a*.

FIGS. 12*a* and 12*b* show a part of the ninth embodiment. A platen 95 has two helical projections 95*a* and 95*b* for black and red inks. There is provided with a black ink roller 96 having a helical projection 96*a* engaging with the periphery of the helical projection 95*a* and with a red ink roller 97 having a helical projection 97*a* engaging the periphery of the helical projection 95*b*. Thus, each ink is transferred to the platen during rotation of the roller.

Figure 13:
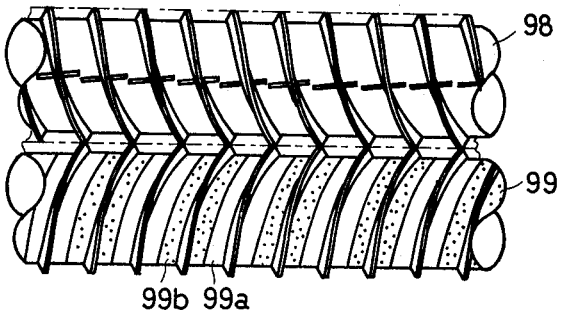
FIG. 13 shows a part of a tenth embodiment of the present invention.

Referring to FIG. 13, the printer comprises a platen 98 and an ink roller 99. The platen 98 is the same as the platen 95 in FIG. 12*a*. The ink roller 99 comprises a black-ink-containing helical portion 99*a* and a red-ink-containing helical portion 99*b*. Each portion has a helical projection engaged with the periphery of the projection of the platen. Thus, both inks contained in the ink roller 99 are fed to the projections of the platen, respectively, so that two-color printing may be performed.

From the foregoing, it will be understood that the present invention provides a dot matrix impact printer provided with an ink roller inking system which may perform the printing without staining the recording paper and which is simplified and compacted.

What is claimed is:

1. A printing mechanism for dot matrix impact printers comprising a platen, a helical separating member made of resilient material provided on the periphery of said platen, a helical disclosed portion of said platen disposed adjacent said helical separating member, the periphery of said helical separating member being higher than said helical disclosed portion, a plurality of hammers arranged in the axial direction of said platen, each of said hammers having a hammer head which is provided to cross said helical disclosed portion, means for feeding ink to the periphery of said helical disclosed portion, means for rotating said platen, and means for moving said hammers to said platen to compress said resilient separating member to perform the dot matrix impact printing.

2. A printing mechanism for dot matrix impact printers according to claim 1 in which said platen is made of porous material in which ink may be contained and moved to the periphery thereof, whereby the platen acts also as said means for feeding ink.

3. A printing mechanism for dot matrix impact printers according to claim 1 in which said means for feeding ink comprises an ink transferring roller and an ink roller made of porous material, said ink transferring roller having a helical projection which has a peripheral diameter equal to that of said helical disclosed portion, said helical disclosed portion of said platen and said helical projection being reversed in lead angle of the helix, said helical projection being touched to said helical disclosed portion and said ink roller, and said ink transferring roller being rotated at the same speed as the platen in the counter-direction and the ink roller is also rotated together with the ink transferring roller, whereby ink contained in said ink roller is transferred to the helical disclosed portion through the ink transferring roller.

4. A printing mechanism for dot matrix impact printers according to claim 1 in which said means for feeding ink comprises an ink roller made of porous material which has a helical projection having a peripheral diameter equal to that of said disclosed portion of said platen, said helical projection and said helical disclosed portion being reversed in lead angle of the helix and touched at the peripheries, said ink roller being rotated at the same speed as the platen in the counter-direction, whereby ink contained in the ink roller is transferred to the helical disclosed portion.

5. A printing mechanism for dot matrix impact printers according to claim 1 in which said helical disclosed portion is a helical projection formed on the periphery of the platen.

6. A printing mechanism for dot matrix impact printers according to claim 1 in which said helical disclosed portion is a helical groove formed by said helical separating member.

7. A printing mechanism for dot matrix impact printers according to claim 1 in which said platen has at least two helical disclosed portions, and said means for feeding ink is adapted to feed separately inks to the helical disclosed portions.

8. A printing mechanism for dot matrix impact printers according to claim 2 in which said platen comprises at least two helical ink-containing portions.

9. A printing mechanism for dot matrix impact printers according to claim 3 in which said platen has at least two helical disclosed portions and said ink transferring roller has helical projections corresponding to the helical disclosed portions.

10. A printing mechanism for dot matrix impact printers according to claim 9 in which said ink transferring roller comprises a plurality of rollers corresponding to the helical disclosed portions.

11. A printing mechanism for dot matrix impact printers according to claim 4 in which said platen has at least two helical disclosed portions and said ink roller has helical projections corresponding the helical disclosed portions.

12. A printing mechanism for dot matrix impact printers according to claim 4 in which said ink roller comprises a plurality of rollers corresponding to the helical disclosed portions.

* * * * *